United States Patent [19]

Lewis et al.

[11] Patent Number: 4,538,091

[45] Date of Patent: Aug. 27, 1985

[54] HIGH-PRESSURE SODIUM LAMP SPRING CLIP CROSS PIECE FOR ELECTRODE AND END PLUG SUPPORT

[75] Inventors: George A. Lewis, Bath; Kent L. Collins, Hammondsport; Joseph C. Benesh, Bath, all of N.Y.; Patrick C. Ward, Sparta, N.J.

[73] Assignee: North American Philips Lighting Corp., New York, N.Y.

[21] Appl. No.: 466,810

[22] Filed: Feb. 16, 1983

[51] Int. Cl.[3] ..... H01J 9/40

[52] U.S. Cl. ..... 313/625; 445/26; 445/29

[58] Field of Search ..... 445/26, 27, 29, 32, 445/33, 44; 24/3 D, 150 B, 161; 269/254 R; 29/229; 313/625

[56] References Cited

U.S. PATENT DOCUMENTS

| | | | |
|---|---|---|---|
| 2,403,666 | 7/1946 | Lubetsky | 29/229 X |
| 2,511,164 | 6/1950 | Koch | 445/26 X |
| 3,992,642 | 11/1976 | McVey et al. . | |
| 4,034,252 | 7/1977 | McVey | 445/44 X |

*Primary Examiner*—Kenneth J. Ramsey

[57] ABSTRACT

A method of assembling the arc tube of a high-pressure sodium lamp is disclosed that comprises using a spring clip to engage the lead wire proximate the end plug on the side opposite the electrode coil assembly. The electrode coil assembly is thereby centered relative to the end plug and the three ends of the clip provide planar support of the end plug/electrode on the end of the arc tube. The clip is formed by bending a refractory metal wire 180° about the midpoint, bending the ends of the legs away from each other while maintaining co-planar geometry, and providing an indentation for engaging the lead wire.

4 Claims, 3 Drawing Figures

HIGH-PRESSURE SODIUM LAMP SPRING CLIP CROSS PIECE FOR ELECTRODE AND END PLUG SUPPORT

BACKGROUND OF THE INVENTION

Because of their great efficacy, high-pressure sodium discharge lamps have become a staple source of highway and area lighting. One of the more difficult, time-consuming processes in the manufacture of a high-pressure sodium lamp is the proper insertion and placement of the electrode structure in the end plug, the placement of the electrode within the arc tube body, and the sealing of the end plug to the arc tube.

In U.S. Pat. No. 3,992,642 dated Nov. 16, 1976 and issued to McVey et al., there is disclosed a coiled member which is part of or attached to the metal lead wire extending through the aperture in the ceramic plug which provides support for the electrode within the arc tube and thermal isolation of the lead wire seal from the electrode.

In U.S. Pat. No. 4,034,252 dated July 5, 1977 and issued to McVey, there is disclosed a cross piece member which is attached to the metal lead wire proximate the alumina plug on the opposite side of the aforementioned metal coil support member. This cross piece, which is spot welded to the lead wire, maintains the electrode coil and lead wire in a fixed position relative to the alumina plug, and forms a wick equalizing the distribution of sealing frit between the plug seal and the in-lead seal. It also serves as a hanger for supporting the plug and electrode assembly in the arc tube during sealing.

The invention described in the above patent requires that the cross piece be welded to the lead wire before the cross piece can be relied upon to secure the electrode assembly in its location or prevent the alumina plug and electrode assembly from falling into the arc tube. The single cross piece member also provides only two-point suspension and does not define a plane within which the alumina plug is held nor does it center the electrode assembly within the aperture in the alumina plug.

SUMMARY OF THE INVENTION

A niobium wire of a predetermined length is bent approximately 180° to form a clip which is slightly larger than the diameter of the end plug. The legs of the open end of the clip are bent outwardly to allow the clip to slide on the lead wire proximate the end plug opposite the electrode coil assembly and engage an indentation at the approximate midpoint of the clip. Thus engaged, the 180° bend of the clip provides one point of suspension and the two diverging leg extremities provide another two points of suspension, thereby providing a total of three-point or planar suspension of the end plug within the arc tube. The electrode structure is also thereby centered within the aperture of the end plug. Sealing frit is then applied to the clip and after the clip is thoroughly wetted, wicking action evenly distributes the frit to seal the electrode lead wire to the end plug and the end plug to the arc tube.

DESCRIPTION OF THE PREFERRED EMBODIMENT

The structure of a high-pressure sodium lamp includes an outer transparent envelope and a base for contacting with a source of electric power. Electrically connected to the base and structurally supported within the outer envelope is an arc tube containing the medium through which the discharge will be maintained. Disposed within the arc tube is a set of electrodes to which a voltage potential is applied and between which the discharge arc is maintained for the production of light.

Figure 1:
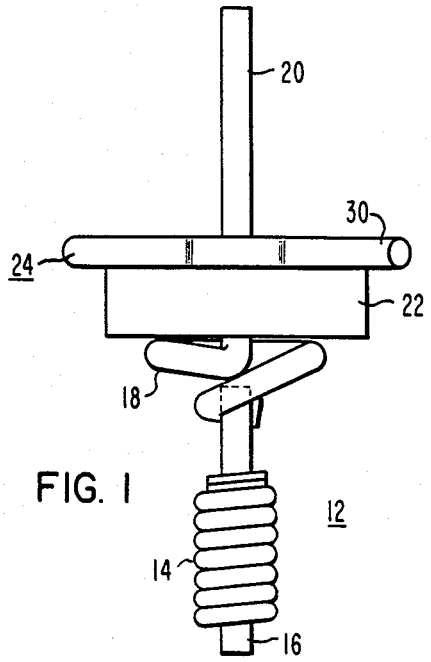
FIG. 1 is a side-elevational view of an assembled electrode coil support member, lead wire, and end plug with the spring clip in place.

FIG. 1 depicts such electrode and its associated structure made by the method of the present invention. Referring in detail to this FIG. 1, an electrode coil assembly 12 is constructed by attaching an electrode coil 14 containing emission material to a peg 16 such as niobium wire. To the completed electrode coil assembly 12 is fixed support member 18 and lead wire 20 which may be continuous, that is, the same structure and made of niobium wire. Lead wire 20 is then placed through an aperture in the end plug 22 until the support member 18 is in contact with the end plug 22.

Figure 2:
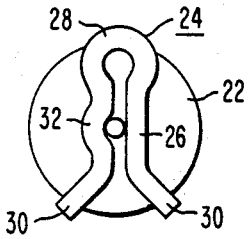
FIG. 2 is a top-elevational view of a completed spring clip.

Referring now to FIG. 2 a spring clip 24 is formed by bending a refractory metal wire such as niobium, tantalum, or molybdenum, the wire being slightly greater in length than twice the diameter of the end plug 22. The wire is bent 180° about the midpoint to form two legs 26 extending substantially parallel from the bend 28 and said legs spaced a distance apart less than the diameter of the lead wire. At a distance greater than the radius of the alumina end plug, but less than the diameter of the end plug from the bend 28, the remaining distance of the legs are bent to diverge from one another, but remaining coplanar with the bent portion 28 and each other to form diverging leg extremities 30. One leg is provided such as by bending or cutting, an indentation 32 near the midpoint of the leg that engages the lead wire 20 and is located at a point that allows the bend 28 of the spring clip and diverging leg extremities 30 to extend beyond the edge of the end plug 22.

The spring clip 24 is inserted onto the lead wire 20 proximate the end plug 22 on the side opposite the support member 18 and the electrode coil assembly 12 so that the indentation 32 in the spring clip 24 engages lead wire 20. The lead wire/support member/electrode coil assembly is thereby properly centered in the end plug. The spring clip may then be welded to the lead wire for additional stability.

Figure 3:
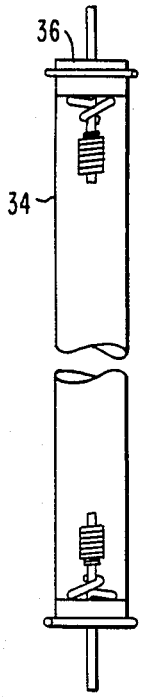
FIG. 3 is a side-elevational view of a completed arc tube utilizing the subject invention.

Referring now to FIG. 3 the completed structure as shown in FIG. 1 is placed within the arc tube such that the electrode is disposed within the arc tube, and three-point planar suspension of the end plug within the arc tube is achieved.

Melted glassy sealing frit such as a eutectic of aluminum oxide and calcium oxide is deposited on and about the spring clip, wetting the clip, and by wicking action draws the frit into any openings between the lead wire 20 and end plug 22 and between the end plug 22 and arc tube 34. The arc tube interior is thereby hermetically sealed from the exterior.

One method of applying said glassy sealing frit is shown in FIG. 3 wherein a wafer of solidified sealing frit 36 with an outside diameter greater than that of the end plug and a predetermined inside diameter such that the volume of the wafer contains a predetermined amount of glassy sealing frit. The end of the arc tube is then placed within an oven of sufficient temperature to melt the sealing frit.

What is claimed is:

1. The method of mounting and sealing an electrode coil assembly, a lead wire, a support member, and a generally cylindrical end plug sized to fit into the end of an arc tube in the construction of a high-pressure sodium lamp, the above-named components in partially completed form including said electrode coil assembly comprising an electrode coil fixed at a location proximate an end of a metal peg, a support member joining said electrode coil assembly to said lead wire a predetermined distance from said electrode coil assembly, and a generally cylindrically shaped end plug having an aperture through which said lead wire extends with the planar surface of said end plug proximate said support member, said method comprising:

forming a refractory metal wire of predetermined length into a uniplanar spring clip which is bent proximate its midpoint through approximately 180° to form two legs which initially extend substantially parallel from the bend for an initial distance which is greater than the radius but less than the diameter of said end plug with the spacing between said parallel legs being less than the diameter of said lead wire, the remaining distance of said legs of the spring clip then diverging from one another but remaining in a single plane, with the total length of each of said legs being a predetermined amount greater than the diameter of said end plug and with one of said legs having a small indentation proximate its midpoint for receiving and frictionally retaining said lead wire between said legs, and located to allow the bend and each of the legs to extend beyond the end plug, inserting said spring clip onto said lead wire proximate the planar surface of said end plug opposite said support member until the small indentation has received said lead wire such that the 180° bend of said spring clip and the diverging leg extremities extend a predetermined amount over the periphery of said end plug, placing the end plug within the arc tube such that the electrode is inside the arc tube and the spring clip provides widely spaced at least three-point suspension of the end plug on the arc tube end perimeter, and depositing a quantity of melted glassy sealing frit comprised primarily of a eutectic of aluminum oxide and calcium oxide to the spring clip, said frit wetting and flowing along said clip, sufficient to hermetically seal said lead wire to said end plug and said end plug to said arc tube when solidified.

2. The method of claim 1 wherein said refractory metal wire is selected from the group consisting of niobium, tantalum, and molybdenum.

3. In an electric discharge lamp arc tube assembly including a ceramic arc tube, a pair of discharge electrodes within said arc tube each adjacent a respective one of the arc tube ends, and a pair of arc tube end closures closing the respective ends of said arc tube, the improvement comprising: at least one of said end closures comprising a ceramic plug having a pair of flat major end surfaces and a central bore extending through said ceramic plug between said pair of flat major surfaces; a conductive electrode support for supporting one of said discharge electrodes adjacent said ceramic plug; a conductive lead wire extending through said central bore and connected to said electrode support; and a refractory metal clip connected to said lead wire outside the arc tube assembly and against the outer major surface of said ceramic plug, said metal clip having an end bend and a pair of legs having generally parallel portions having lengths greater than the radius and less than the diameter of said ceramic plug and extending away from said end bend; and said legs having diverging end portions that diverge away from each other, the total length of each of said legs being greater than the diameter of said ceramic plug, one of said clip legs having a surface indentation facing the other of said clip legs with the space between the clip legs at the indentation being less than the diameter of said lead wire, said lead wire extending between said clip legs at said indentation and being frictionally retained therebetween with said clip against the outer major surface of said ceramic plug, the clip end bend and clip leg ends extending beyond the plug for limiting the depth of insertion of said plug into said arc tube, and the clip end bend and clip legs lying in a plane with the clip end bend and clip leg ends defining at least three points of contact with said arc tube.

4. In an electric discharge lamp arc tube assembly, the structure comprising the improvement of claim 3 at each end of the arc tube.

* * * * *